US011390820B2

(12) United States Patent
Lindner et al.

(10) Patent No.: US 11,390,820 B2
(45) Date of Patent: Jul. 19, 2022

(54) HIGH NAPHTHENIC CONTENT NAPHTHA FUEL COMPOSITIONS

(71) Applicant: ExxonMobil Technology and Engineering Company, Annandale, NJ (US)

(72) Inventors: Matthew H. Lindner, Washington, NJ (US); Scott K. Berkhous, Center Valley, PA (US); Mike T. Noorman, Doylestown, PA (US); Gregory K. Lilik, Media, PA (US); Shifang Luo, Annandale, NJ (US); Ian J. Laurenzi, Hampton, NJ (US); Jasmina Poturovic, Spring, TX (US)

(73) Assignee: ExxonMobil Technology and Engineering Company, Annandale, NJ (US)

( * ) Notice: Subject to any disclaimer, the term of this patent is extended or adjusted under 35 U.S.C. 154(b) by 0 days.

(21) Appl. No.: 17/325,965

(22) Filed: May 20, 2021

(65) Prior Publication Data

US 2021/0363450 A1 Nov. 25, 2021

Related U.S. Application Data

(60) Provisional application No. 63/028,724, filed on May 22, 2020.

(51) Int. Cl.
*C10L 1/16* (2006.01)
*C10L 1/08* (2006.01)
(Continued)

(52) U.S. Cl.
CPC ..... *C10L 1/1616* (2013.01); *C10L 1/08* (2013.01); *C10L 2200/0415* (2013.01);
(Continued)

(58) Field of Classification Search
CPC ..... C10G 35/04; C10G 7/00; C10L 1/023; C10L 1/06; C10L 1/08; C10L 1/1616;
(Continued)

(56) References Cited

U.S. PATENT DOCUMENTS 3,755,140 A 8/1973 Pollitzer
5,100,534 A 3/1992 Le et al.
(Continued)

FOREIGN PATENT DOCUMENTS

GB 1162626 A 8/1969

OTHER PUBLICATIONS

Ohmes et al., "Impact of Light Tight Oils on Distillate Hydrotreater Operation", Petroleum Technology Quarterly, May 2016, pp. 25-33.
(Continued)

*Primary Examiner* — Ellen M McAvoy
*Assistant Examiner* — Chantel L Graham
(74) *Attorney, Agent, or Firm* — Robert A. Migliorini

(57) ABSTRACT

Naphtha boiling range compositions are provided that are formed from crude oils with unexpected combinations of high naphthenes to aromatics weight and/or volume ratio and a low sulfur content. The resulting naphtha boiling range fractions can have a high naphthenes to aromatics weight ratio, a low but substantial content of aromatics, and a low sulfur content. In some aspects, the fractions can be used as fuels and/or fuel blending products after fractionation with minimal further refinery processing. In other aspects, the amount of additional refinery processing, such as hydrotreatment, catalytic reforming and/or isomerization, can be reduced or minimized. By reducing, minimizing, or avoiding the amount of hydroprocessing needed to meet fuel and/or fuel blending product specifications, the fractions derived from the high naphthenes to aromatics ratio and low
(Continued)

| Property | Units | Low CI Naphtha (1) | Low CI Naphtha (2) | Low CI Naphtha (3) | Low CI Naphtha (4) | Low CI Naphtha (5) | Comparative Example |
|---|---|---|---|---|---|---|---|
| Boiling Range | °F | 88-395 | 88-395 | 88-395 | 88-395 | 88-395 | 88-395 |
| T10 | °F | 188.23 | 184.87 | 185.18 | 181.66 | 188.77 | 176.04 |
| T50 | °F | 253.96 | 250.59 | 246.53 | 247.23 | 248.49 | 236.98 |
| T90 | °F | 339.40 | 339.44 | 339.75 | 338.71 | 335.73 | 334.94 |
| Paraffins | wt% | 44.23 | 46.47 | 44.44 | 48.05 | 51.34 | 44.34 |
| n-paraffins | wt% | 22.67 | 22.73 | 21.67 | 23.31 | 24.82 | 23.06 |
| Isoparaffins | wt% | 21.57 | 23.74 | 22.76 | 24.74 | 26.52 | 21.28 |
| Olefins | wt% | 0 | 0 | 0 | 0 | 0 | 0 |
| Naphthenes | wt% | 44.72 | 43.78 | 48.55 | 45.30 | 40.66 | 42.10 |
| Aromatics | wt% | 11.05 | 9.75 | 7.02 | 6.64 | 8.00 | 13.54 |
| Naphthenes/Aromatics | wt% | 4.05 | 4.49 | 6.92 | 6.82 | 5.08 | 3.11 |
| Smoke Point | mm | 28.81 | 30.42 | 31.57 | 29.66 | 29.98 | 28.57 |
| Threshold Sooting Index | | 6.71 | 5.9 | 5.4 | 6.11 | 6.16 | 6.34 |
| Sulfur | ppm-wt | 44.18 | 77.00 | 38.01 | 60.84 | 5.73 | 553.24 |
| RVP | psi | 2.49 | 2.66 | 2.62 | 2.84 | 2.44 | 3.08 |
| RON | ON | 51.19 | 51.57 | 50.84 | 50.94 | 49.96 | 54.22 |
| RON blend value | ON | 68.63 | 68.21 | 69.19 | 69.28 | 67.86 | 68.66 |
| MON | ON | 55.97 | 55.60 | 56.45 | 56.59 | 54.59 | 56.98 |
| MON blend value | ON | 69.49 | 69.17 | 70.13 | 70.22 | 69.03 | 69.24 |
| Sensitivity (RON-MON) | ON | -4.77 | -4.03 | -5.61 | -5.65 | -4.63 | -2.76 |
| Kin.Viscosity @ 40°C | cSt | 0.82 | 0.83 | 0.81 | 0.74 | 0.82 | 0.74 |

sulfur crudes can provide fuels and/or fuel blending products having a reduced or minimized carbon intensity.

31 Claims, 8 Drawing Sheets

(51) Int. Cl.

| | |
|---|---|
| ***C10G 45/02*** | (2006.01) |
| ***C10G 45/44*** | (2006.01) |
| ***C10G 7/00*** | (2006.01) |
| ***C10G 67/02*** | (2006.01) |
| ***C10L 1/04*** | (2006.01) |
| ***C10L 1/02*** | (2006.01) |

(52) U.S. Cl.
CPC . *C10L 2200/0469* (2013.01); *C10L 2290/543* (2013.01); *C10L 2290/60* (2013.01)

(58) Field of Classification Search
CPC ..... C10L 2200/0415; C10L 2200/0469; C10L 2270/023; C10L 2270/04; C10L 2290/543; C10L 2290/60
See application file for complete search history.

(56) References Cited

U.S. PATENT DOCUMENTS

| | | | | |
|---|---|---|---|---|
| 10,316,263 | B2 | 6/2019 | Rubin-Pitel et al. | |
| 2002/0063082 | A1 | 5/2002 | Touvelle et al. | |
| 2009/0013590 | A1 | 1/2009 | Lamprecht et al. | |
| 2011/0319695 | A1* | 12/2011 | Hommeltoft ..... | C10G 29/205 585/724 |
| 2012/0246999 | A1 | 10/2012 | Stern et al. | |
| 2012/0261308 | A1 | 10/2012 | Klein et al. | |
| 2016/0265324 | A1* | 9/2016 | Keith ..... | G06Q 50/06 |
| 2017/0183575 | A1* | 6/2017 | Rubin-Pitel ..... | C10G 21/14 |

OTHER PUBLICATIONS

International Search Report and Written Opinion PCT/US2021/033568 dated Sep. 8, 2021.

* cited by examiner

| Property | Units | Low CI Naphtha (1) | Low CI Naphtha (2) | Low CI Naphtha (3) | Low CI Naphtha (4) | Low CI Naphtha (5) |
|---|---|---|---|---|---|---|
| Boiling Range | °F | 68-158 | 68-158 | 68-158 | 68-158 | 68-158 |
| Paraffins | wt% | 46.6 | 48.4 | 50.5 | 48.3 | 49.4 |
| Isoparaffins | wt% | 40.1 | 37.3 | 40.0 | 38.3 | 39.3 |
| Olefins | wt% | 0.021 | 0 | 0.007 | 0.007 | 0.008 |
| Naphthenes | wt% | 11.3 | 13.1 | 8.8 | 11.8 | 10.4 |
| Aromatics | wt% | 1.7 | 1.3 | 0.7 | 1.5 | 0.9 |
| Naphthenes/Aromatics | wt%/wt% | 6.6 | 10.4 | 12.9 | 7.7 | 12.3 |
| Aniline Point | °F | 153.7 | 152.4 | 154.3 | 153.7 | 153.2 |
| Smoke Point | mm | 35.5 | 34.1 | 34.6 | 34.5 | 33.9 |
| Threshold Sooting Index | - | 5.98 | 6.57 | 5.97 | 6.37 | 6.03 |
| Sulfur | ppm-wt | 8 | <3 | <3 | <3 | <3 |
| RON | ON | 73.4 | 71.1 | 71.2 | 70.9 | 70.0 |
| RON after isomerization | ON | 87.8 | 87.1 | 88.0 | 87.5 | 87.6 |
| MON | ON | 68.1 | 65.6 | 65.2 | 66.7 | 64.6 |

FIG. 3

| Property | *Units* | Low CI Naphtha (1) | Low CI Naphtha (2) | Low CI Naphtha (3) | Low CI Naphtha (4) | Low CI Naphtha (5) | Comparative Example |
|---|---|---|---|---|---|---|---|
| **Boiling Range** | *°F* | 88-395 | 88-395 | 88-395 | 88-395 | 88-395 | 88-395 |
| **T10** | *°F* | 188.23 | 184.87 | 185.18 | 181.66 | 188.77 | 176.04 |
| **T50** | *°F* | 253.96 | 250.59 | 246.53 | 247.23 | 248.49 | 236.98 |
| **T90** | *°F* | 339.40 | 339.44 | 339.75 | 338.71 | 335.73 | 334.94 |
| **Paraffins** | *wt%* | 44.23 | 46.47 | 44.44 | 48.05 | 51.34 | 44.34 |
| **n-paraffins** | *wt%* | 22.67 | 22.73 | 21.67 | 23.31 | 24.82 | 23.06 |
| **Isoparaffins** | *wt%* | 21.57 | 23.74 | 22.76 | 24.74 | 26.52 | 21.28 |
| **Olefins** | *wt%* | 0 | 0 | 0 | 0 | 0 | 0 |
| **Naphthenes** | *wt%* | 44.72 | 43.78 | 48.55 | 45.30 | 40.66 | 42.10 |
| **Aromatics** | *wt%* | 11.05 | 9.75 | 7.02 | 6.64 | 8.00 | 13.54 |
| **Naphthenes/Aromatics** | *wt%* | 4.05 | 4.49 | 6.92 | 6.82 | 5.08 | 3.11 |
| **Smoke Point** | *mm* | 28.81 | 30.42 | 31.57 | 29.66 | 29.98 | 28.57 |
| **Threshold Sooting Index** | | 6.71 | 5.9 | 5.4 | 6.11 | 6.16 | 6.34 |
| **Sulfur** | *ppm-wt* | 44.18 | 77.00 | 38.01 | 60.84 | 5.73 | 553.24 |
| **RVP** | *psi* | 2.49 | 2.66 | 2.62 | 2.84 | 2.44 | 3.08 |
| **RON** | *ON* | 51.19 | 51.57 | 50.84 | 50.94 | 49.96 | 54.22 |
| **RON blend value** | *ON* | 68.63 | 68.21 | 69.19 | 69.28 | 67.86 | 68.66 |
| **MON** | *ON* | 55.97 | 55.60 | 56.45 | 56.59 | 54.59 | 56.98 |
| **MON blend value** | *ON* | 69.49 | 69.17 | 70.13 | 70.22 | 69.03 | 69.24 |
| **Sensitivity (RON-MON)** | *ON* | -4.77 | -4.03 | -5.61 | -5.65 | -4.63 | -2.76 |
| **Kin.Viscosity @ 40°C** | *cSt* | 0.82 | 0.83 | 0.81 | 0.74 | 0.82 | 0.74 |

FIG. 5

| Property | Units | Low CI Naphtha Example (1) | Low CI Naphtha Example (2) | Low CI Naphtha Example (3) | Low CI Naphtha Example (4) | Low CI Naphtha Example (5) | Low CI Naphtha Example (6) | Comparative Example |
|---|---|---|---|---|---|---|---|---|
| **Boiling Range** | *°F* | 250-440 | 250-440 | 250-440 | 250-440 | 250-440 | 250-440 | 250-440 |
| **T10** | *°F* | 296.06 | 295.30 | 295.04 | 296.08 | 295.61 | 292.90 | 293.12 |
| **T50** | *°F* | 333.95 | 332.56 | 331.98 | 333.70 | 332.80 | 327.25 | 328.66 |
| **T90** | *°F* | 392.24 | 392.31 | 391.80 | 391.86 | 391.51 | 388.76 | 391.09 |
| **Paraffins** | *wt%* | 43.16 | 43.69 | 45.16 | 44.64 | 47.83 | 54.80 | 40.52 |
| **n-paraffins** | *wt%* | 21.31 | 20.44 | 22.2 | 21.23 | 22.99 | 26.73 | 19.33 |
| **Isoparaffins** | *wt%* | 21.86 | 23.26 | 22.96 | 23.4 | 24.84 | 28.07 | 21.19 |
| **Olefins** | *wt%* | 0 | 0 | 0 | 0 | 0 | 0 | 0 |
| **Naphthenes** | *wt%* | 43.6 | 44.47 | 41.24 | 45.03 | 42.15 | 34.00 | 42.76 |
| **Aromatics** | *wt%* | 13.23 | 11.81 | 13.59 | 10.32 | 10.01 | 11.20 | 16.51 |
| **Naphthenes/Aromatics** | *wt%* | 3.30 | 3.77 | 3.03 | 4.36 | 4.21 | 3.04 | 2.59 |
| **Smoke Point** | *mm* | 26.57 | 26.64 | 28.72 | 27.3 | 28.62 | 28.59 | 24.47 |
| **Threshold Sooting Index** | | 11.66 | 11.65 | 10.27 | 11.18 | 10.37 | 10.24 | 13.16 |
| **Sulfur** | *ppm-wt* | 27.9 | 98.97 | 90.89 | 42.53 | 26.77 | 32.14 | 1036.61 |
| **RVP** | *psi* | 0.19 | 0.2 | 0.2 | 0.19 | 0.2 | 0.21 | 0.21 |
| **RON** | *ON* | 35.98 | 33.38 | 35.88 | 32.90 | 31.88 | 30.52 | 41.12 |
| **RON blend value** | *ON* | 60.88 | 60.48 | 60.27 | 60.55 | 60.64 | 59.57 | 60.12 |
| **MON** | | 40.3 | 38.41 | 39.60 | 38.18 | 37.65 | 35.78 | 41.75 |
| **MON blend value** | *ON* | 63.93 | 63.85 | 63.48 | 64.0 | 64.12 | 63.4 | 62.78 |
| **Sensitivity (RON-MON)** | *ON* | -4.32 | -5.03 | -3.72 | -5.28 | -5.77 | -5.26 | -0.66 |
| **Kin.Viscosity @ 40°C** | *cSt* | 1.12 | 1.02 | 1.10 | 1.12 | 1.13 | 1.10 | 1.04 |

FIG. 7

| Property | Method | Unit | Kero 1 | Kero 2 | Kero 3 | Kero 4 | Kero 5 | Kero 6 | Kero 7 |
|---|---|---|---|---|---|---|---|---|---|
| **Density at 15.6°C** | D4052 | g/ml | 0.821 | 0.815 | 0.804 | 0.815 | 0.805 | 0.811 | |
| **API Gravity** | D4052 | - | 40.6 | 41.9 | 44.3 | 41.8 | 44.1 | 42.8 | 39.2 |
| **Pour Point** | D5949 | °C | -44 | -46 | -43 | -41 | -42 | -40 | -42 |
| **Cloud Point** | D5773 | °C | -40 | -38 | -38 | -36 | -34 | -35 | -37 |
| **Freeze Point** | D5972 | °C | -34.5 | -35.8 | -34.5 | -32.5 | -32.8 | -32.2 | -32.5 |
| **Sulfur Content** | D2622 | mass % | 0.020 | 0.007 | 0.005 | 0.005 | 0.005 | | |
| **Nitrogen Content** | D4629 | mg/kg | 5.9 | <5 | <5 | <5 | <5 | 3.9 | 4.1 |
| **GC Distillation** | | | | | | | | | |
| **Temp, 10% off** | D2887, Calc. from °F | °C | 196 | 194 | 193 | 196 | 196 | 201 | 197 |
| **Temp, 50% off** | D2887, Calc. from °F | °C | 239 | 236 | 236 | 242 | 239 | 243 | 246 |
| **Temp, 90% off** | D2887, Calc. from °F | °C | 284 | 282 | 281 | 287 | 286 | 289 | 287 |
| **Composition** | | | | | | | | | |
| **Paraffins** | | wt% | 38.3 | 41.4 | 54.1 | 43.9 | 51.9 | 40.99 | 32.05 |
| **1-Ring Naphthenes** | | wt% | | | | | | 21.21 | 18.79 |
| **1-Ring Aromatics** | | wt% | | | | | | 10.81 | 16.67 |
| **Total Naphthenes** | | wt% | 47.4 | 50.2 | 39.4 | 47.3 | 43.2 | 43.43 | 42.33 |
| **Total Aromatics** | | wt% | 14.3 | 8.3 | 6.5 | 8.8 | 5.0 | 15.58 | 25.62 |

FIG. 8

HIGH NAPHTHENIC CONTENT NAPHTHA FUEL COMPOSITIONS

CROSS-REFERENCE TO RELATED APPLICATIONS

This application claims the benefit of U.S. Provisional Application Ser. No. 63/028,724 filed May 22, 2020, which is herein incorporated by reference in its entirety.

FIELD

This disclosure relates to naphtha boiling compositions having high naphthenic content and low aromatic content, fuel compositions or fuel blendstock compositions made from naphtha boiling range compositions, and methods for forming such fuel compositions.

BACKGROUND

Historically, naphtha boiling range fuels have been produced from the processing and upgrading of traditional crude oils. These crudes can range quite substantially in composition and properties, but generally all have compositional similarities—i.e. they contain a broad range of compositional constituents (paraffins, isoparaffins, naphthenes, aromatics) and contain percent levels of sulfur, asphaltenes and other residual materials. These crudes require a significant amount of processing/upgrading to produce optimal fuel product distributions. Common refinery processes necessary to update these crude feedstocks may include: distillation, hydrotreatment, cracking (hydrocracking, FCC, visbreaking, coking, etc.), and alkylation. Depending on the quality of the initial crude feedstock, the degree of processing and the associated qualities of the products can vary substantially. Not only can this result in variations of the final compositions and qualities of the fuels, but also in the amount of resources required to convert the crude feedstocks into the various fuel products.

The amount of resources required for processing of initial crude feedstocks to form naphtha boiling range fuels can substantially increase the carbon intensity of the resulting distillate fuels. It would be desirable to develop compositions and corresponding methods of making compositions that can produce naphtha boiling range fuels with reduced or minimized carbon intensities.

An article titled "Impact of Light Tight Oils on Distillate Hydrotreater Operation" in the May 2016 issue of Petroleum Technology Quarterly describes hydroprocessing of kerosene and diesel boiling range fractions derived from tight oils.

U.S. Patent Application Publication 2017/0183575 describes fuel compositions formed during hydroprocessing of deasphalted oils for lubricant production.

SUMMARY

In some aspects, a naphtha boiling range composition is provided. The naphtha boiling range composition includes a T90 distillation point of 80° C. or less, a naphthenes content of 6.0 wt % to 15 wt %, a naphthenes to aromatics weight ratio of 6.0 or more, and a sulfur content of 10 wppm or less. Optionally, the naphtha boiling range composition can include a research octane number of 70 or more, or 85 or more.

In some aspects, a naphtha boiling range composition is provided. The naphtha boiling range composition includes a T10 distillation point of 30° C. or more, a T90 distillation point of 210° C. or less, a naphthenes content of 35 wt % to 50 wt %, a naphthenes to aromatics weight ratio of 4.0 or more, and a sulfur content of 100 wppm or less. Optionally, the naphtha boiling range composition can include a naphthenes to aromatics ratio of 4.5 or more, and a T90 distillation point of 80° C. to 180° C. Optionally, the naphtha boiling range composition can include a research octane number of 55 or less and/or a blending research octane number of 60 or more.

In some other aspects, a naphtha boiling range composition is provided. The naphtha boiling range composition includes a T10 distillation point of 140° C. or more, a T90 distillation point of 210° C. or less, a naphthenes content of 34 wt % to 50 wt %, a naphthenes to aromatics weight ratio of 3.0 or more, and a sulfur content of 100 wppm or less. In some aspects, use of such naphtha boiling range compositions (or compositions including such naphtha boiling range compositions) as a fuel in an engine, a furnace, a burner, a combustion device, or a combination thereof is provided. Optionally, the naphtha boiling range composition has not been exposed to hydroprocessing conditions. Optionally, the naphtha boiling range composition (or the composition including the naphtha boiling range composition) can have a carbon intensity of 94 g $CO_2$eq/MJ of lower heating value or less.

In some aspects, a method for forming such naphtha boiling range compositions is provided. The method can include fractionating a crude oil comprising a final boiling point of 600° C. or more to form at least a naphtha boiling range fraction, the crude oil comprising a naphthenes to aromatics volume ratio of 3.0 or more and a sulfur content of 0.2 wt % or less.

BRIEF DESCRIPTION OF THE DRAWINGS

FIG. 3 shows measured compositional values and properties for various straight run light naphtha fractions.

FIG. 5 shows modeled compositional values and properties for various straight run full-range naphtha fractions; specifically showing five select high naphthene-to-aromatic ratio naphthas and one conventional naphtha from FIG. 4.

FIG. 7 shows modeled compositional values and properties for various heavy straight run naphtha fractions; specifically showing six select high naphthene-to-aromatic ratio naphthas and one conventional naphtha from FIG. 6.

FIG. 8 shows measured compositional values and properties for various straight run kerosene boiling range fractions.

DETAILED DESCRIPTION

Figure 1:
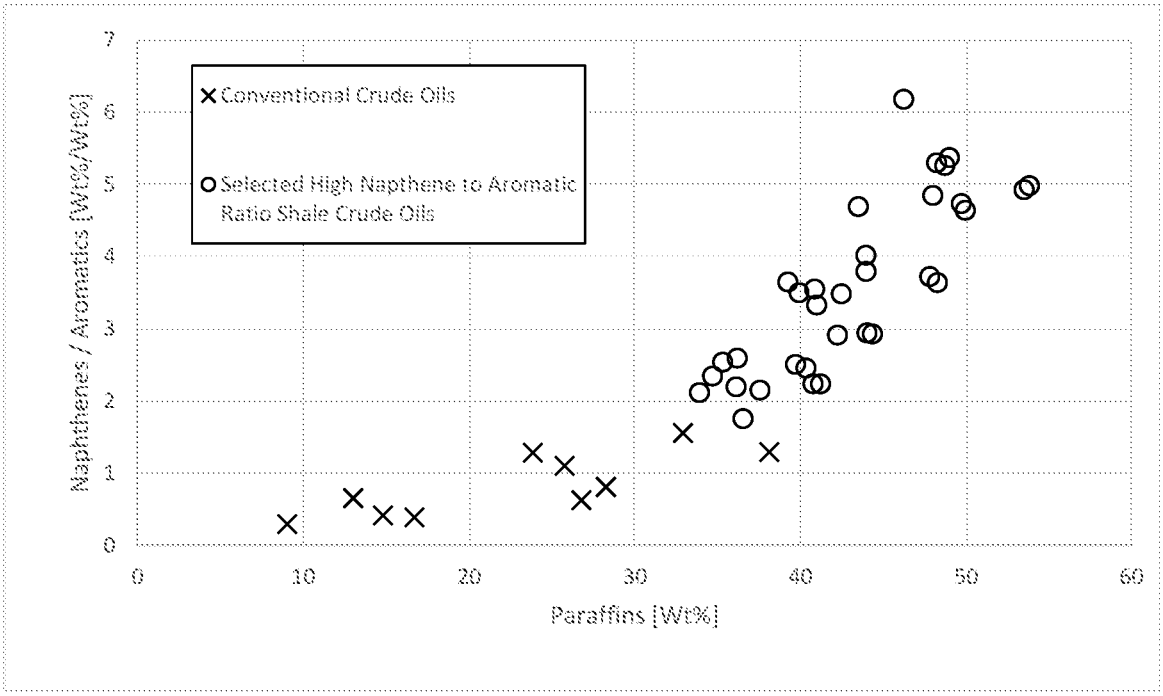
FIG. 1 shows compositional information for various crude oils.

In various aspects, naphtha boiling range compositions are provided that are formed from crude oils with unexpected combinations of high naphthenes to aromatics weight and/or volume ratio and a low sulfur content. This unexpected combination of properties is characteristic of crude oils that can be fractionated to form naphtha boiling range compositions that can be used as fuels/fuel blending products with reduced or minimized processing. The resulting naphtha boiling range fractions can have a high naphthenes to aromatics weight ratio, a low but substantial content of aromatics, and a low sulfur content. In some aspects, the fractions can be used as fuels and/or fuel blending products after fractionation with minimal further refinery processing. In such aspects, the fractions can be used as fuels and/or fuel blending products without exposing the fractions to hydroprocessing and/or other energy intensive refinery processes. In other aspects, the amount of additional refinery processing, such as hydrotreatment, catalytic reforming and/or isomerization, can be reduced or minimized. By reducing, minimizing, or avoiding the amount of hydroprocessing needed to meet fuel and/or fuel blending product specifications, the fractions derived from the high naphthenes to aromatics ratio and low sulfur crudes can provide fuels and/or fuel blending products having a reduced or minimized carbon intensity. In other words, due to this reduced or minimized processing, the net amount of $CO_2$ generation that is required to produce a fuel or fuel blending component and then use the resulting fuel can be reduced. The reduction in carbon intensity can be on the order of 1%-10% of the total carbon intensity for the fuel. This is an unexpected benefit, given the difficulty in achieving even small improvements in carbon intensity for conventional fuels and/or fuel blending products.

Generally, the naphthenes to aromatics weight ratio in a naphtha boiling range fraction, prior to hydrotreating, can be 3.0 or more, or 4.0 or more, or 4.5 or more, or 5.0 or more, or 5.5 or more, or 6.0 or more, such as up to 15, or possibly still higher. For naphtha fractions including a heavy naphtha portion, the naphthenes to aromatics ratio can be up to 7, or possibly still higher.

The nature of the high naphthenes to aromatics ratio can vary depending on the type of naphtha fraction. For a naphtha fraction that includes only light naphtha, such as a naphtha fraction with a T90 distillation point of 80° C. or less, or 70° C. or less, the amount of aromatics in the naphtha fraction can be relatively low. For example, for a light naphtha fraction, the aromatics content can be 3.0 wt % or less, or 2.0 wt % or less, or 1.5 wt % or less, such as down to 0.5 wt % or possibly still lower. For such light naphtha fractions, the increased naphthenes to aromatics ratio is due to having little or no aromatics while having a low but substantial naphthenes content.

By contrast, in aspects where the naphtha fraction has a T90 distillation point of 70° C. or more, 80° C. or more, 100° C. or more, or 170° C. or more, the high naphthenes to aromatics ratio is not due to an excessively low content of aromatics. For example, such a naphtha boiling range composition can include 6.0 wt % to 14 wt % of aromatics, or 6.0 wt % to 11 wt %, or 7.0 wt % to 11.0 wt %, or 9.0 wt % to 14 wt %/o or 6.0 wt % to 9.0 wt %, or 7.0 wt % to 10.0 wt %. In such aspects, the increased naphthenes to aromatics weight ratio is due to an unexpectedly high content of naphthenes relative to the content of aromatics. In such aspects, the naphthenes content of the naphtha fraction can be 34 wt % to 50 wt %, or 35 we % to 50 wt %, or 34 wt % to 45 wt %, or 40 wt % to 50 wt %, or 43 wt % to 48 wt %.

In addition to a high naphthenes to aromatics ratio, the naphtha compositions can have a sulfur content, prior to any optional hydrotreating, of 100 wppm or less, or 80 wppm or less, or 50 wppm or less, or 30 wppm or less, or 10 wppm or less, such as down to 0.5 wppm or possibly still lower.

In various aspects, a naphtha boiling range composition having a high naphthenes to aromatics ratio, a low sulfur content, and optionally a low but substantial aromatics content can be used, for example, as a straight run blend component for gasoline. Additionally or alternately, a naphtha fraction having a sulfur content of 2.0 wppm or less, or 1.0 wppm or less can be used as a straight run feed for isomerization and/or catalytic reforming. In other words, the naphtha fraction can be used without exposing the naphtha fraction to hydroprocessing conditions, thereby reducing or minimizing the amount of refinery processing. In various aspects, a naphtha boiling fuel/fuel component formed at least in part from a naphtha boiling range composition with reduced or minimized refinery processing can have a carbon intensity from 1% to 10% lower (or possibly more) relative to a naphtha boiling range fuel that was hydroprocessed.

Yet another property of the naphtha boiling range fractions is an unexpected increase in blending octane number relative to the research octane number. The blending octane number represents the octane number for a naphtha fraction when blended with another fraction. In various aspects, the research octane number for a full-range naphtha fraction can be between 44 and 55, or 47 and 52, while the blending octane number can be between 60 and 70, or 65 and 70, or 68 and 70. In various aspects, the research octane number for a heavy naphtha fraction can be between 25 and 40, or 30 and 38, or 30 and 36, while the blending octane number can be between 55 and 65, or 56 and 63.

Still other properties of a naphtha boiling range composition can include a smoke point of 25 mm to 36 mm, or 28 mm to 35 mm; a threshold sooting index of 12 or less, or 7 or less, or 6 or less; and/or a kinematic viscosity at 40° C. of 0.74 cSt to 0.92 cSt. or 0.78 cSt to 0.9 cSt, or 0.80 cSt to 0.88 cSt.

For a straight run naphtha fraction, having a high naphthenes to aromatics ratio while still having a low but substantial aromatics content is unexpected due to the ring structures present in both naphthenes and aromatics. Conventionally, a high naphthenes to aromatics ratio would be considered unfavorable due to the lower octane of naphthenes relative to aromatics. However, it has been unexpectedly discovered that the high naphthenes to aromatics ratio naphtha fractions have a blending octane number comparable to a conventional naphtha, while including a reduced or minimized amount of aromatics. Because aromatics in gasoline tend to increase the amount of undesirable emissions, the unexpected combination of low aromatics while maintaining a desirable octane (research octane number and/or motor octane number) is beneficial. Additionally, due to regulations that restrict benzene content in naphtha boiling range fuels, a naphtha boiling range fuel that can provide high octane as a blending component while having reduced aromatics is beneficial.

In addition to having a reduced or minimized carbon intensity as a separate fuel fraction, a naphtha boiling range fraction having a high naphthenes to aromatics ratio and a low but substantial aromatics content can also be combined with one or more renewable fuel fractions to form a fuel with a reduced carbon intensity. Renewable fuel fractions include, for example, bio-derived ethanol, renewable ethers (such as methyl- or ethyl-tert-butyl ethers), and renewable isooctane. Such a blend has synergistic advantages, as blending a naphtha boiling range fraction as described herein with a renewable fraction can provide a low aromatic content gasoline that also has a reduced carbon intensity.

The lower carbon intensity of a fuel containing at least a portion of a naphtha boiling fraction as described herein can be realized by using a fuel containing at least a portion of such a naphtha boiling range fraction in any convenient type of combustion device. In some aspects, a fuel containing at least a portion of a naphtha boiling range fraction as described herein can be used as fuel for a combustion engine in a ground transportation vehicle, an aircraft engine, a marine vessel, or another convenient type of vehicle. Still other types of combustion devices can include generators, furnaces, engines in yard equipment, and other combustion devices that are used to provide heat or power.

Based on the unexpected combinations of compositional properties, the naphtha boiling range compositions can be used to produce fuels and/or fuel blending products that also generate reduced or minimized amounts of other undesired combustion products. The other undesired combustion products that can be reduced or minimized can include sulfur oxide compounds ($SO_x$), soot, particulate matter, and nitrogen oxide compounds (NOx). The low sulfur oxide production is due to the unexpectedly low sulfur content of the compositions. The high naphthenes to aromatics ratio can allow for a cleaner burning fuel, resulting in less incomplete combustion that produces soot and NOx.

It has been discovered that selected shale crude oils are examples of crude oils having an unexpected combination of high naphthenes to aromatics ratio, a low but substantial content of aromatics, and a low sulfur content. In various aspects, a shale oil fraction can be included as part of a fuel or fuel blending product. Examples of shale oils that provide this unexpected combination of properties include selected shale oils extracted from the Permian basin. For convenience, unless otherwise specified, it is understood that references to incorporation of a shale oil fraction into a fuel also include incorporation of such a fraction into a fuel blending product.

Definitions

All numerical values within the detailed description and the claims herein are modified by "about" or "approximately" the indicated value, and take into account experimental error and variations that would be expected by a person having ordinary skill in the art.

In this discussion, a shale crude oil is defined as a petroleum product with a final boiling point greater than 550° C., or greater than 600° C., which is extracted from a shale petroleum source. A shale oil fraction is defined as a boiling range fraction derived from a shale crude oil.

Unless otherwise specified, distillation points and boiling points can be determined according to ASTM D2887. For samples that are outside the scope of ASTM D2887, D7169 can be used. It is noted that still other methods of boiling point characterization may be provided in the examples. The values generated by such other methods are believed to be indicative of the values that would be obtained under ASTM D2887 and/or D7169.

In this discussion, the jet fuel boiling range or kerosene boiling range is defined as 140° C. to 300° C. A jet fuel boiling range fraction or a kerosene boiling range fraction is defined as a fraction with an initial boiling point of 140°C or more, a T10 distillation point of 205° C. or less, and a final boiling point of 300° C. or less.

In this discussion, the naphtha boiling range is defined as roughly 30° C. to 200° C. It is noted that the boiling point of $C_5$ paraffins is roughly 30° C., so the naphtha boiling range can alternatively be referred to as $C_5$—200° C. A naphtha boiling range fraction is defined as a fraction having a T10 distillation point of 30° C. or more and a T90 distillation point of 180° C. or less. In some aspects, a light naphtha fraction can have a T10 distillation point of 30° C. or more and a T90 distillation point of 80° C. or less. In some aspects, a heavy naphtha fraction can have a T10 distillation point of 60° C. or more, or 80° C. or more, and a T90 distillation point of 180° C. or less. A shale oil naphtha boiling range fraction is defined as a shale oil fraction corresponding to the naphtha boiling range.

In this discussion, the distillate boiling range is defined as 170° C. to 566° C. A distillate boiling range fraction is defined as a fraction having a T10 distillation point of 170° C. or more and a 190 distillation point of 566° C. or less. The diesel boiling range is defined as 170° C. to 370° C. A diesel boiling range fraction is defined as a fraction having a T10 distillation point of 170° C. or more, a final boiling point of 300° C. or more, and a T90 distillation point of 370° C. or less. An atmospheric resid is defined as a bottoms fraction having a T10 distillation point of 149° C. or higher, or 350° C. or higher. A vacuum gas oil boiling range fraction (also referred to as a heavy distillate) can have a T10 distillation point of 350° C. or higher and a 190 distillation point of 535° C. or less. A vacuum resid is defined as a bottoms fraction having a T10 distillation point of 500° C. or higher, or 565° C. or higher. It is noted that the definitions for distillate boiling range fraction, kerosene (or jet fuel) boiling range fraction, diesel boiling range fraction, atmospheric resid, and vacuum resid are based on boiling point only. Thus, a distillate boiling range fraction, kerosene fraction, or diesel fraction can include components that did not pass through a distillation tower or other separation stage based on boiling point. A shale oil distillate boiling range fraction is defined as a shale oil fraction corresponding to the distillate boiling range. A shale oil kerosene (or jet fuel) boiling range fraction is defined as a shale oil fraction corresponding to the kerosene boiling range. A shale oil diesel boiling range fraction is defined as a shale oil fraction corresponding to the diesel boiling range.

In some aspects, a shale oil fraction that is incorporated into a fuel or fuel blending product can correspond to a shale oil fraction that has not been hydroprocessed and/or that has not been cracked. In this discussion, a non-hydroprocessed fraction is defined as a fraction that has not been exposed to more than 10 psia of hydrogen in the presence of a catalyst comprising a Group VI metal, a Group VIII metal, a catalyst comprising a zeolitic framework, or a combination thereof. In this discussion, a non-cracked fraction is defined as a fraction that has not been exposed to a temperature of 400° C. or more.

In this discussion, a hydroprocessed fraction refers to a hydrocarbon fraction and/or hydrocarbonaceous fraction that has been exposed to a catalyst having hydroprocessing activity in the presence of 300 kPa-a or more of hydrogen at a temperature of 200° C. or more. Examples of hydroprocessed fractions include hydroprocessed naphtha fractions (i.e., a hydroprocessed fraction having the naphtha boiling range). A hydroprocessed fraction can be hydroprocessed prior to separation of the fraction from a crude oil or another wider boiling range fraction.

With regard to characterizing properties of naphtha boiling range fractions and/or blends of such fractions with other components to form naphtha boiling range fuels, a variety of methods can be used. Density of a blend at 15° C. ($kg/m^3$) can be determined according ASTM D4052. Sulfur (in wppm or wt %) can be determined according to ASTM D2622. Smoke point can be determined according to ASTM D1322. Research octane number (RON) can be determined according to ASTM D2699, while motor octane number (MON) can be determined according to ASTM D2700. Blending octane number can be determined by making blends of a naphtha sample with a known reference fluid (such as toluene or isooctane) and calculating the octane increase as a function of increasing concentration by using D2699 and/or D2700 to determine the RON and MON (respectively) of the blends. Aromatics content can be determined according to D1319. Naphthenes and paraffins can be determined using ASTM D6730.

In this discussion, the term "paraffin" refers to a saturated hydrocarbon chain. Thus, a paraffin is an alkane that does not include a ring structure. The paraffin may be straight-chain or branched-chain and is considered to be a non-ring compound. "Paraffin" is intended to embrace all structural isomeric forms of paraffins.

In this discussion, the term "naphthene" refers to a cycloalkane (also known as a cycloparaffin). The term naphthene encompasses single-ring naphthenes and multi-ring naphthenes. The multi-ring naphthenes may have two or more rings, e.g., two-rings, three-rings, four-rings, five-rings, six-rings, seven-rings, eight-rings, nine-rings, and ten-rings. The rings may be fused and/or bridged. The naphthene can also include various side chains, such as one or more alkyl side chains of 1-10 carbons.

In this discussion, the term "saturates" refers to all straight chain, branched, and cyclic paraffins. Thus, saturates correspond to a combination of paraffins and naphthenes.

In this discussion, the term "aromatic ring" means five or six atoms joined in a ring structure wherein (i) at least four of the atoms joined in the ring structure are carbon atoms and (ii) all of the carbon atoms joined in the ring structure are aromatic carbon atoms. Aromatic rings having atoms attached to the ring (e.g., one or more heteroatoms, one or more carbon atoms, etc.) but which are not part of the ring structure are within the scope of the term "aromatic ring." Additionally, it is noted that ring structures that include one or more heteroatoms (such as sulfur, nitrogen, or oxygen) can correspond to an "aromatic ring" if the ring structure otherwise falls within the definition of an "aromatic ring".

In this discussion, the term "non-aromatic ring" means four or more carbon atoms joined in at least one ring structure wherein at least one of the four or more carbon atoms in the ring structure is not an aromatic carbon atom. Aromatic carbon atoms can be identified using, e.g., $^{13}C$ Nuclear magnetic resonance, for example. Non-aromatic rings having atoms attached to the ring (e.g., one or more heteroatoms, one or more carbon atoms, etc.), but which are not part of the ring structure, are within the scope of the term "non-aromatic ring."

In this discussion, the term "aromatics" refers to all compounds that include at least one aromatic ring. Such compounds that include at least one aromatic ring include compounds that have one or more hydrocarbon substituents. It is noted that a compound including at least one aromatic ring and at least one non-aromatic ring falls within the definition of the term "aromatics".

It is noted that that some hydrocarbons present within a feed or product may fall outside of the definitions for paraffins, naphthenes, and aromatics. For example, any alkenes that are not part of an aromatic compound would fall outside of the above definitions. Similarly, non-aromatic compounds that include a heteroatom, such as sulfur, oxygen, or nitrogen, are not included in the definition of paraffins or naphthenes.

Life Cycle Assessment and Carbon Intensity

Life cycle assessment (LCA) is a method of quantifying the "comprehensive" environmental impacts of manufactured products, including fuel products, from "cradle to grave". Environmental impacts may include greenhouse gas (GHG) emissions, freshwater impacts, or other impacts on the environment associated with the finished product. The general guidelines for LCA are specified in ISO 14040.

The "carbon intensity" of a fuel product (e.g. gasoline) is defined as the life cycle GHG emissions associated with that product (kg $CO_2$eq) relative to the energy content of that fuel product (MJ, LHV basis). Life cycle GHG emissions associated with fuel products must include GHG emissions associated with crude oil production; crude oil transportation to a refinery; refining of the crude oil; transportation of the refined product to point of "fill"; and combustion of the fuel product.

GHG emissions associated with the stages of refined product life cycles are assessed as follows.

(1) GHG emissions associated with drilling and well completion—including hydraulic fracturing, shall be normalized with respect to the expected ultimate recovery of sales-quality crude oil from the well.

(2) All GHG emissions associated with the production of oil and associated gas, including those associated with (a) operation of artificial lift devices, (b) separation of oil, gas, and water, (c) crude oil stabilization and/or upgrading, among other GHG emissions sources shall be normalized with respect to the volume of oil transferred to sales (e.g. to crude oil pipelines or rail). The fractions of GHG emissions associated with production equipment to be allocated to crude oil, natural gas, and other hydrocarbon products (e.g. natural gas liquids) shall be specified accordance with ISO 14040.

(3) GHG emissions associated with rail, pipeline or other forms of transportation between the production site(s) to the refinery shall be normalized with respect to the volume of crude oil transferred to the refinery.

(4) GHG emissions associated with the refining of crude oil to make liquefied petroleum gas, gasoline, distillate fuels and other products shall be assessed, explicitly accounting for the material flows within the refinery. These emissions shall be normalized with respect to the volume of crude oil refined.

(5) All of the preceding GHG emissions shall be summed to obtain the "Well to refinery" (WTR) GHG intensity of crude oil (e.g. kg $CO_2$eq/bbl crude).

(6) For each refined product, the WTR GHG emissions shall be divided by the product yield (barrels of refined product/barrels of crude), and then multiplied by the share of refinery GHG specific to that refined product. The allocation procedure shall be conducted in accordance with ISO 14040. This procedure yields the WTR GHG intensity of each refined product (e.g. kg $CO_2$eq/bbl gasoline).

(7) GHG emissions associated with rail, pipeline or other forms of transportation between the refinery and point of fueling shall be normalized with respect to the volume of each refined product sold. The sum of the GHG emissions associated with this step and the previous step of this procedure is denoted the "Well to tank" (WTT) GHG intensity of the refined product.

(8) GHG emissions associated with the combustion of refined products shall be assessed and normalized with respect to the volume of each refined product sold.

(9) The "carbon intensity" of each refined product is the sum of the combustion emissions (kg $CO_2$eq/bbl) and the "WIT" emissions (kg $CO_2$eq/bbl) relative to the energy value of the refined product during combustion. Following the convention of the EPA Renewable Fuel Standard 2, these emissions are expressed in terms of the lower heating value (LHV) of the fuel, i.e. g $CO_2$eq/MJ refined product (LHV basis).

In the above methodology, the dominant contribution for the amount of $CO_2$ produced per MJ of refined product is the $CO_2$ formed during combustion of the product. Because the $CO_2$ generated during combustion is such a high percentage of the total carbon intensity, achieving even small or incremental reductions in carbon intensity has traditionally been challenging. In various aspects, it has been discovered that naphtha fractions derived from selected crude oils can be used to form fuels with reduced carbon intensities. The selected crude oils correspond to crude oils with high naphthenes to aromatics ratios, low sulfur content, and a low but substantial aromatics content. This combination of features can allow for formation of a naphtha fraction from the crude oil that requires a reduced or minimized amount of refinery processing in order to make a fuel product and/or fuel blending product.

In this discussion, a low carbon intensity fuel or fuel blending product corresponds to a fuel or fuel blending product that has reduced GHG emissions per unit of lower of heating value relative to a fuel or fuel blending product derived from a conventional petroleum source. In some aspects, the reduced GHG emissions can be due in part to reduced refinery processing. For example, fractions that are not hydroprocessed for sulfur removal have reduced well-to-refinery emissions relative to fractions that require hydroprocessing prior to incorporation into a fuel. In various aspects, an unexpectedly high weight ratio of naphthenes to aromatics in a shale oil fraction can indicate a fraction with reduced GHG emissions, and therefore a lower carbon intensity.

For a conventionally produced naphtha boiling range fuel, a carbon intensity of 96.2 g $CO_2$eq/MJ refined product or more would be expected based on life cycle analysis. By reducing or minimizing refinery processing, a naphtha boiling range fuel can be formed with a carbon intensity of 95 g $CO_2$eq/MJ of lower heating value or less, or 94 g $CO_2$eq/MJ or less, or 92 g $CO_2$eq or less, or 90 g $CO_2$eq/MJ of lower heating value or less, or 88 g $CO_2$eq/MJ of lower heating value or less, such as down to 86 g $CO_2$eq/MJ of lower heating value or possibly still lower.

Yet other ways of reducing carbon intensity for a hydrocarbon fraction can be related to methods used for extraction of a crude oil. For example, carbon intensity for a fraction can be reduced by using solar power, hydroelectric power, or another renewable energy source as the power source for equipment involved in the extraction process, either during drilling and well completion and/or during production of crude oil. As another example, extracting crude oil from an extraction site without using artificial lift can reduce the carbon intensity associated with a fuel.

Optional Treatment of Naphtha Fractions

In some aspects, a naphtha boiling range fraction can be used as a heating fuel or an automotive fuel without hydroprocessing of the naphtha fraction. In other aspects, one or more types of processing can be performed on a naphtha boiling range fraction. Examples of types of processing include, but are not limited to, hydrotreatment, isomerization, and reforming.

Optionally, a naphtha boiling range fraction can be treated in one or more hydrotreatment stages. The hydrotreatment can be performed before or after fractionation to form the naphtha boiling range fraction or diesel boiling range fraction. Generally, the processing conditions will fall within the following ranges: 475° F. to 600° F. (246° C. to 316° C.), 150 psig to 500 psig (~1.0 MPag to ~3.5 MPag) total pressure, 100 psig to 300 psig (~0.7 MPag to 2.1 MPag) hydrogen partial pressure, 1000 to 2500 SCF/B hydrogen treat gas (170 to 425 $Nm^3/m^3$), and 1-10 $hr^{-1}$ LHSV. Examples of naphtha hydrotreating catalysts can include catalysts having combinations of Co, Ni, Mo, and W supported on a refractory oxide support, such as silica and/or alumina.

Another optional process for a naphtha fraction is isomerization, to reform the paraffins in the naphtha to higher octane branched paraffins (i.e., isoparaffins). Due to sulfur sensitivity of the catalysts used for paraffin isomerization, the naphtha feed to an isomerization process can preferably have a sulfur content of 1.0 wppm or less, such as down to 0.1 wppm, or possibly still lower. In some aspects, a straight run light naphtha fraction as describe herein can have a sufficiently low sulfur content for use as a feed for paraffin isomerization. In other aspects, a naphtha feed including a heavy naphtha portion can be exposed to hydrotreatment conditions prior to use as a feed for paraffin isomerization.

An example of a paraffin isomerization catalyst can correspond to a catalyst that includes an alumina base, a platinum group element (Pt, Pd, Ru, Rh, Os, Ir) or Ge, and a chloride component. Other types of catalysts are also available, although higher isomerization temperatures may be needed. The temperature for the paraffin isomerization process can be between 40° C. to 270° C., or 40° C. to 180° C. depending on the nature of the catalyst. A variety of pressures and space velocities may be used, such as pressures from 50 psig to 1500 psig (~0.3 MPag to 10.3 MPag) and space velocities from 0.1 $hr^{-1}$ to 50 $hr^{-1}$.

Still another option can be to use a naphtha boiling range fraction as a feed for a catalytic reforming process. Catalytic reforming can be used to convert naphthenes in a naphtha fraction into aromatics, which both generates hydrogen (which can be used in other refinery processes) and produces a naphtha product with increased octane. Optionally, some of the higher octane components generated during catalytic reforming, such as xylenes, can be separated out for use as specialty chemicals.

A wide variety of catalysts can potentially be used for catalytic reforming. Generally, the catalysts can include Pt or another metal with hydrogenation/dehydrogenation activity on a support. Optionally, the support can have acidic properties, such as a support that includes some aluminum chloride. Catalytic reforming is one of the older refinery processes used in modern refineries. Preferably, the feed to a catalytic reforming process can also have a sulfur content of 1 wppm or less.

Characterization of Shale Crude Oils and Shale Oil Fractions—General

Shale crude oils were obtained from a plurality of different shale oil extraction sources. Assays were performed on the shale crude oils to determine various compositional characteristics and properties for the shale crude oils. The shale crude oils were also fractionated to form various types of fractions, including fractionation into atmospheric resid fractions, vacuum resid fractions, distillate fractions (including kerosene, diesel, and vacuum gas oil boiling range fractions), and naphtha fractions. Various types of characterization and/or assays were also performed on these additional fractions.

The characterization of the shale crude oils and/or crude oil fractions included a variety of procedures that were used to generate data. For example, data for boiling ranges and fractional distillation points was generated using methods similar to compositional or pseudo compositional analysis such as ASTM D6730 and/or ASTM D2887. For compositional features, such as the amounts of paraffins, isoparaffins, olefins, naphthenes, and/or aromatics in a crude oil and/or crude oil fraction, data was generated using methods similar to compositional or pseudo compositional analysis such as ASTM D6730 and/or ASTM D6839. Data related to smoke point was generated using methods similar to ASTM D1322. Data related to sulfur content of a crude oil and/or crude oil fraction was generated using methods similar to ASTM D2622, ASTM D4294, and/or ASTM D5443. Data related to density (such as density at 15° C.) was generated using methods similar to ASTM D1298 and/or ASTM D4052. Data related to kinematic viscosity (such as kinematic viscosity at 40° C.) was generated using methods similar to ASTM D445 and/or ASTM D7042.

The data and other measured values for the shale crude oils and shale oil fractions were then incorporated into an existing data library of other representative conventional and non-conventional crude oils for use in an empirical model. The empirical model was used to provide predictions for compositional characteristics and properties for some additional shale oil fractions that were not directly characterized experimentally. In this discussion, data values provided by this empirical model will be described as modeled data. In this discussion, data values that are not otherwise labeled as modeled data correspond to measured values and/or values that can be directly derived from measured values. An example of such an empirical model is AVEVA Spiral Suite 2019.3 Assay by AVEVA Solutions Limited.

Figure 2:
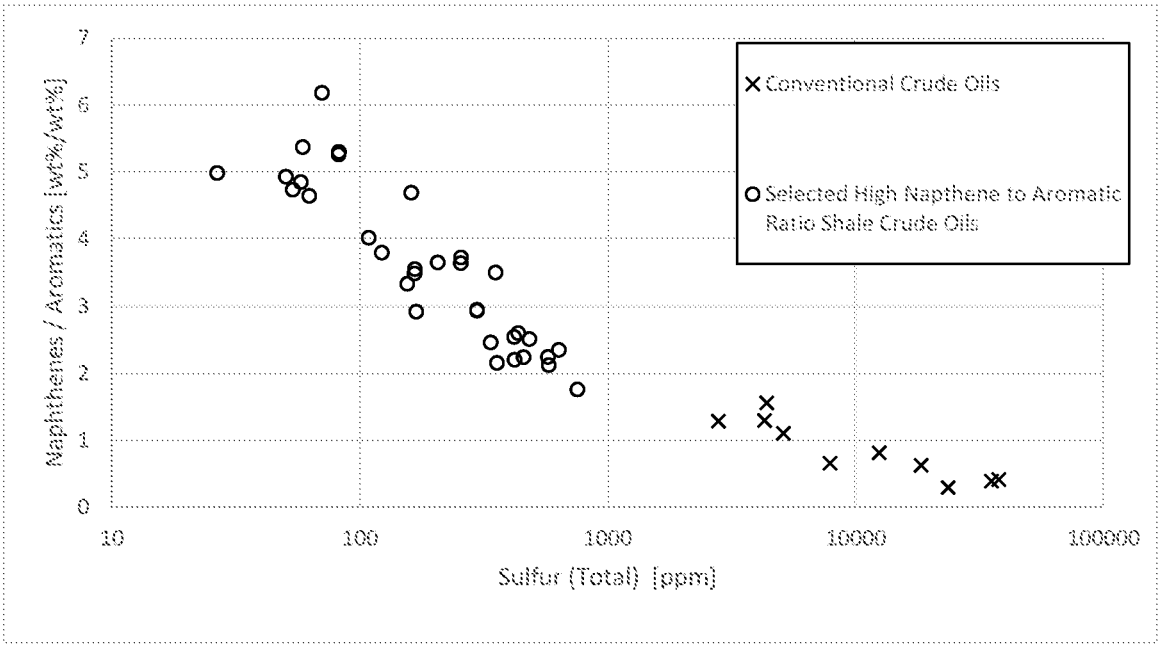
FIG. 2 shows compositional information for various crude oils.

FIGS. 1 and 2 show examples of the unexpected combinations of properties for shale crude oils that have a high weight ratio and/or volume ratio of naphthenes to aromatics. In FIG. 1, both the weight ratio and the volume ratio of naphthenes to aromatics is shown for five shale crude oils relative to the weight/volume percentage of paraffins in the shale crude oil. The top plot in FIG. 1 shows the weight ratio of naphthenes to aromatics, while the bottom plot shows the volume ratio. A plurality of other representative conventional crudes are also shown in FIG. 1 for comparison. As shown in FIG. 1, the selected shale crude oils described herein have a paraffin content of greater than 40 wt % while also having a weight ratio of naphthenes to aromatics of 1.8 or more. Similarly, as shown in FIG. 1, the selected shale crude oils described herein have a paraffin content of greater than 40 vol % while also having a weight ratio of naphthenes to aromatics of 2.0 or more. By contrast, none of the conventional crude oils shown in FIG. 1 have a similar combination of a paraffin content of greater than 40 wt % and a weight ratio of naphthenes to aromatics of 1.8 or more, or a combination of paraffin content of greater than 40 vol % and a weight ratio of naphthenes to aromatics of 2.0 or more. It has been discovered that this unexpected combination of naphthenes to aromatics ratio and paraffin content is present throughout various fractions that can be derived from such selected crude oils.

In FIG. 2, both the volume ratio and weight ratio of naphthenes to aromatics is shown for the five shale crude oils in FIG. 1 relative to the weight of sulfur in the crude. The sulfur content of the crude in FIG. 2 is plotted on a logarithmic scale. The top plot in FIG. 2 shows the weight ratio of naphthenes to aromatics, while the bottom plot shows the volume ratio. The plurality of other representative conventional crude oils are also shown for comparison. As shown in FIG. 2, the selected shale crude oils have naphthene to aromatic volume ratios of 2.0 or more, while all of the conventional crude oils have naphthene to aromatic volume ratios below 1.8. Similarly, as shown in FIG. 2, the selected shale crude oils have naphthene to aromatic weight ratios of 1.8 or more, while all of the conventional crude oils have naphthene to aromatic weight ratios below 1.6. Additionally, the selected shale crude oils have a sulfur content of roughly 0.1 wt % or less, while all of the conventional crude oils shown in FIG. 2 have a sulfur content of greater than 0.2 wt %. It has been discovered that this unexpected combination of high naphthene to aromatics ratio and low sulfur is present within various fractions that can be derived from such selected crude oils. This unexpected combination of properties contributes to the ability to produce low carbon intensity fuels from shale oil fractions and/or blends of shale oil fractions derived from the shale crude oils.

Characterization of Shale Oil Fractions—Naphtha Boiling Range Straight Run Fractions In various aspects, naphtha boiling range fractions as described herein can be used as a fuel fraction. The unexpected combination of low sulfur and high naphthenes to aromatics ratio (optionally in combination with a low but substantial content of aromatics) can allow a naphtha fraction to be used as a fuel fraction with a reduced or minimized amount of refinery processing.

FIG. 3 shows measured values for light naphtha fractions derived from five different shale crude oils and/or crude oil blends. The naphtha fractions in FIG. 3 correspond to straight run light naphtha fractions that were formed based on distillation cut points of 25° C. and 70° C. The sulfur content of the light naphtha fractions was 10 wppm or less, or 5 wppm or less.

As shown in FIG. 3, the light naphtha fractions had a measured naphthenes content between 6.0 wt % to 15 wt %, or 8.0 wt % to 15 wt %, or 8.0 wt % to 13.5 wt %. The light naphtha fractions also had an aromatics content of less than 5.0 wt %, or less than 2.0 wt %, or less than 1.0 wt %, such as down to 0.5 wt %. This unexpected combination of naphthenes and aromatics resulted in a weight ratio of naphthenes to aromatics ranging from 6.0 to 15.0, or 6.0 to 14, or 6.0 to 13.0.

Additionally, the naphtha fractions shown in FIG. 3 had an aniline point of 65° C. to 70° C.; a smoke point of 33 mm to 36 mm; and a research octane number of 70 to 75.

Because of the low sulfur content of the light naphtha fractions, the light naphtha fractions were suitable for use as a feed to an isomerization process without being exposed to hydroprocessing conditions. As shown in FIG. 3, using the light naphtha fractions as a feed for an isomerization process resulted in isomerized light naphtha fractions with a research octane number of 87 to 90.

Figure 4:
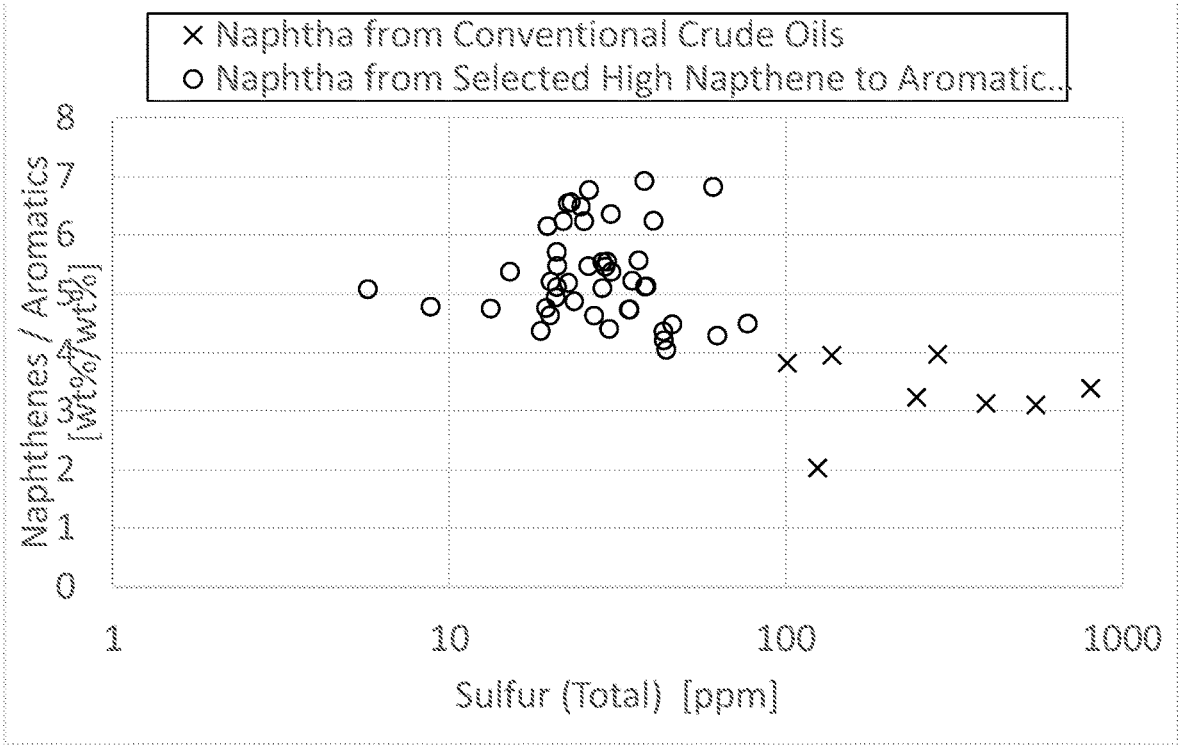
FIG. 4 shows modeled compositional information for various straight run full-range naphtha fractions.

FIG. 4 shows compositional information for full-range naphtha fractions derived from the same shale crude oil sources as the light naphtha fractions shown in FIG. 3, as well as compositional information for full-range naphtha fractions derived from conventional crude oils.

FIG. 5 shows compositional properties and values for modeled full-range naphtha fractions derived from the same shale crude oil sources as the light naphtha fractions shown in FIG. 3. FIG. 5 also shows a modeled full-range naphtha fraction from a representative conventional light, sweet crude. The modeled full-range naphtha fractions in FIG. 4 and FIG. 5 had a T10 distillation point of 75° C. to 100° C., or 78° C. to 99° C., a T50 distillation point of 110° C. to 140° C., or 114° C. to 137° C., and a T90 distillation point of 160° C. to 180° C., or 165° C. to 175° C. It is noted that the T50 distillation point was somewhat higher than the T50 distillation point of the conventional naphtha fraction having an otherwise similar boiling range.

The modeled full-range naphtha fractions shown in FIG. 4 and FIG. 5 had a naphthenes content between 35 wt % to 50 wt % and an aromatics content of 6.0 wt % to 11 wt %. This is in contrast to the naphtha from the conventional crude oil, which had an aromatics content greater than 12 wt %. The unexpected combination of a high naphthenes content and a low but substantial aromatics content results in a weight ratio of naphthenes to aromatics between 4.0 to 10, or 4.0 to 9.0, or 4.0 to 8.0, or 4.0 to 7.0.

Additionally, the modeled full-range naphtha fractions shown in FIG. 4 and FIG. 5 have a research octane number between 40 and 55, or 44 to 53 that is lower than the research octane number of the corresponding conventional naphtha fraction. However, the blending research octane number for the modeled full-range naphtha fractions are between 60 and 75, or 65 and 70, which is comparable to the blending research octane number for the conventional naphtha fraction. Thus, the unexpected combination of high naphthene to aromatics weight ratio and low but substantial aromatics content results in a naphtha fraction with similar octane in blends to a conventional, higher aromatics fraction. It is also noted that the octane sensitivity (research octane number–motor octane number) ranges from −4.0 to −8.0, which is greater than the sensitivity for the corresponding conventional naphtha fraction.

Other properties of the modeled full-range naphtha fraction include a smoke point of 28 mm to 36 mm, or 28 mm to 32 mm.

Figure 6:
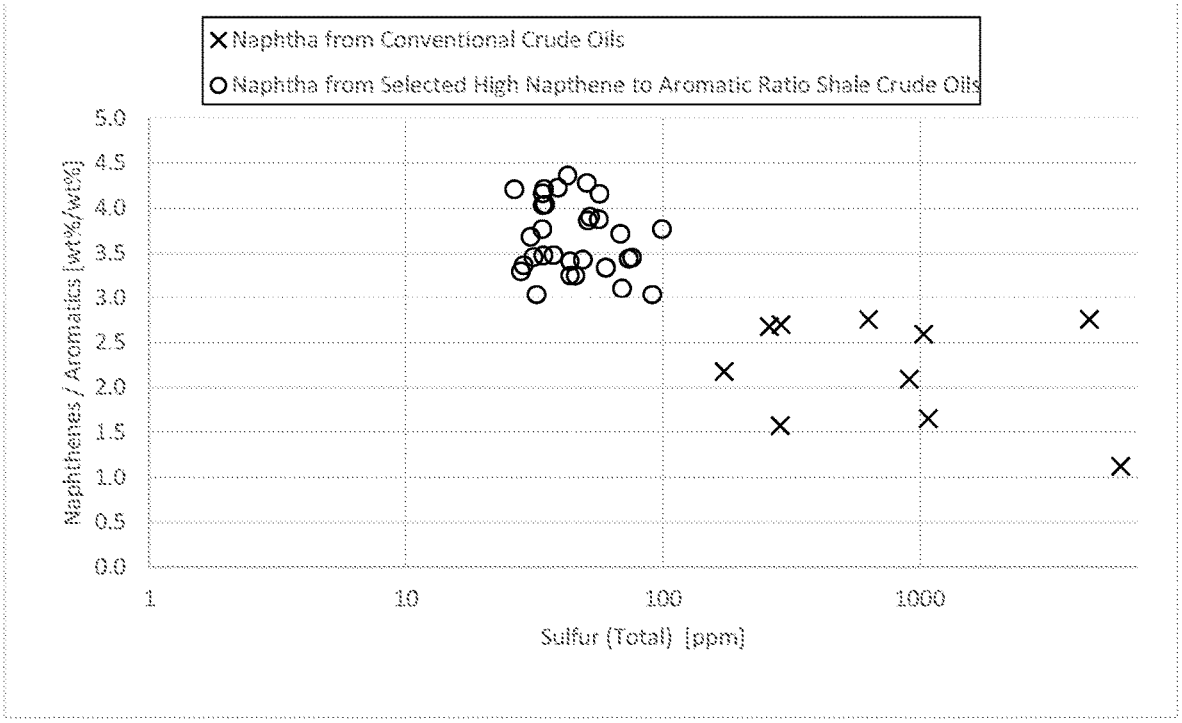
FIG. 6 shows modeled compositional information for various heavy straight run naphtha fractions.

FIG. 6 shows compositional information for heavy naphtha fractions derived from the same shale crude oil sources as the light naphtha fractions shown in FIG. 3, as well as compositional information for heavy naphtha fractions derived from conventional crude oils.

FIG. 7 shows compositional properties and values for modeled heavy naphtha fractions derived from the same shale crude oil sources as the light naphtha fractions shown in FIG. 3. FIG. 7 also shows a modeled heavy naphtha fraction from a representative conventional light, sweet crude. The modeled heavy naphtha fractions shown in FIG. 6 and FIG. 7 had a T10 distillation point of 140° C. to 150° C., or 142° C. to 148° C. a T50 distillation point of 155° C. to 170° C., or 160° C. to 170° C., and a T90 distillation point of 190° C. to 210° C., or 195° C. to 205° C., or 198° C. to 201° C.

The modeled heavy naphtha fractions shown in FIG. 6 and FIG. 7 had a naphthenes content between 34 wt % to 50 wt %, or 34 wt % to 45 wt %, and an aromatics content of 9 wt % to 14 wt %, or 10 wt % to 14 wt %. This is in contrast to the naphtha from the conventional crude oil, which had an aromatics content greater than 15 wt %. The unexpected combination of a high naphthenes content and a low but substantial aromatics content results in a weight ratio of naphthenes to aromatics between 3.0 and 4.5.

Characterization of Shale Oil Fractions—Kerosene Boiling Range Fraction

To further illustrate the unexpected nature of the naphtha boiling range fractions derived from the high naphthene to aromatics ratio crude oils, a comparison can be made between kerosene fractions derived from the high naphthene to aromatics ratio crude oils described herein versus kerosene fractions derived from other shale crude oils.

FIG. 8 shows measured values for kerosene fractions derived from seven different shale crude oils and/or crude oil blends. As shown in FIG. 8, the kerosene fractions had a naphthenes content between 38 wt % to 52 wt %, or 39 wt % to 51 wt %. The kerosene fractions also had an aromatics content between 4.0 wt % to 27 wt %, or 4.0 wt % to 16 wt %, or 4.0 wt % to 12 wt %, or 4.0 wt % to 10 wt %. The weight ratio of naphthenes to aromatics ranged from 1.5 to 10. Some of the kerosene fractions had an unexpected combination of high naphthenes to aromatics weight ratio and a low but substantial content of aromatics. For such fractions, the aromatics content was 4.0 wt % to 16 wt %, or 4.0 wt % to 12 wt %, or 4.0 wt % to 10 wt %. For such fractions, the naphthenes to aromatics ratio was 3.3 to 10, or 4.0 to 10, or 5.0 to 10, or 6.0 to 10.

In addition to the naphthenes and aromatics contents, the kerosene fractions shown in FIG. 8 had a density at 15'C between 0.80 and 0.83 g/ml, or between 0.80 g/ml and 0.82 g/ml; a pour point between −40° C. and −50° C., or −40° C. to −48° C.; a cloud point between −32° C. and −42° C., or −32° C. to −40° C.; and a freeze point between −30° C. and −38° C. The fractions had a T10 distillation point of 201° C. or less, or 196° C. or less. The fractions also had a T90 distillation point of 289° C. or less, or 287° C. or less. Although not shown in FIG. 8, the fractions also had an initial boiling point of 140° C. or more and a final boiling point of 300° C. or less.

As a comparison for the data in FIG. 8, an article titled "Impact of Light Tight Oils on Distillate Hydrotreater Operation" in the May 2016 issue of Petroleum Technology Quarterly included a listing of paraffin and aromatics contents for shale oils from a variety of shale oil formations. Comparative Table 1 shows the data provided from that article. Comparative Table 1 also includes a column for a representative kerosene fraction derived from West Texas Intermediate, a conventional light sweet crude oil. It is noted that the representative sulfur content reported in the article for WTI was greater than 1000 wppm.

In Comparative Table 1, the kerosene fractions correspond to fractions having a boiling range of 350° F.-500° F. (177° C. to 260° C.). The values for paraffins and aromatics correspond to wt % as reported in the article. The naphthenes value is a maximum potential value calculated based on the reported paraffins and aromatics values. (The actual naphthenes value could be lower due to the presence of polar compounds.) This naphthenes weight percent was Comparative TABLE 1

| | Comparative Kerosene Fractions | | | | | | | |
|---|---|---|---|---|---|---|---|---|
| | WTI | Bakken | Eagle Ford | Bach Ho | Cossack | Gipps-land | Kutubu | Qua Iboe |
| Paraffins | 42 | 35 | 45 | 54 | 43 | 47 | 36 | 30 |
| Aromatics | 14 | 16 | 13 | 12 | 17 | 20 | 21 | 17 |
| Naphthenes (calculated, maximum potential) | 44 | 49 | 42 | 34 | 40 | 33 | 43 | 53 |
| Naphthenes to Aromatics ratio | 3.1 | 3.0 | 3.2 | 2.8 | 2.4 | 1.7 | 2.0 | 3.1 |

As shown in Comparative Table 1, the highest naphthenes to aromatics ratio show is 3.2. All but one of the fractions in Comparative Table 1 had an aromatics content of 13 wt % or more, while the remaining fraction had an aromatics content of 12 wt % but a naphthenes to aromatics weight ratio of less than 3.0. The data in Comparative Table 1 demonstrates that the unexpected combination of high naphthenes to aromatics weight ratio and low but substantial aromatics content is not an inherent property of shale oil kerosene fractions. Instead, it has been discovered that selected shale crude oils can provide naphtha and/or kerosene fractions with an unexpected combination of properties.

PCT/EP Clauses:

1. A naphtha boiling range composition comprising a T10 distillation point of 30'C or more, a T90 distillation point of 210° C. or less, a naphthenes content of 35 wt % to 50 wt %, a naphthenes to aromatics weight ratio of 4.0 or more, and a sulfur content of 100 wppm or less.

2. The naphtha boiling range composition of clause 1, wherein the naphtha boiling range composition comprises a naphthenes to aromatics ratio of 4.5 or more.

3. The naphtha boiling range composition of clauses 1-2, wherein the naphtha boiling range composition comprises a T90 distillation point of 80° C. to 180° C.

4. The naphtha boiling range composition of clauses 1-3, wherein the naphtha boiling range composition comprises a research octane number of 55 or less, or wherein the naphtha boiling range composition comprises a blending research octane number of 60 or more, or a combination thereof.

5. The naphtha boiling range composition of clauses 1-4, wherein the naphtha boiling range composition comprises a smoke point of 25 mm or more.

6. Use of a composition comprising the naphtha boiling range composition of clauses 1-5 as a fuel in an engine, a furnace, a burner, a combustion device, or a combination thereof.

7. Use of the composition according to clause 6, wherein the naphtha boiling range composition has not been exposed to hydroprocessing conditions.

8. Use of the composition according to clauses 6-7, wherein the naphtha boiling range composition comprises a carbon intensity of 94 g $CO_2$eq/MJ of lower heating value or less.

9. A naphtha boiling range composition comprising a T9 distillation point of 80'C or less, a naphthenes content of 6.0 wt % to 15 wt %, a naphthenes to aromatics weight ratio of 6.0 or more, and a sulfur content of 10 wppm or less.

10. The naphtha boiling range composition of clause 9, wherein the naphtha boiling range composition comprises a research octane number of 70 or more.

11. The naphtha boiling range composition of clauses 9-10, wherein the naphtha boiling range composition comprises a research octane number of 85 or more.

12. The naphtha boiling range composition of clauses 9-11, wherein the naphtha boiling range composition comprises an aniline point of 65° C. to 70° C., a smoke point of 32 mm or more, or a combination thereof.

13. Use of a composition comprising the naphtha boiling range composition of clauses 9-12 as a fuel in an engine, a furnace, a burner, a combustion device, or a combination thereof.

14. Use of a composition according to clause 13, wherein the naphtha boiling range composition has not been exposed to hydroprocessing conditions.

15. Use of a composition according to clauses 13-14, wherein the naphtha boiling range composition comprises a carbon intensity of 94 g $CO_2$eq/MJ of lower heating value or less.

16. A naphtha boiling range composition comprising a T10 of 140° C. or more, a T90 distillation point of 210° C. or less, a naphthenes content of 34 wt % to 50 wt %, a naphthenes to aromatics weight ratio of 3.0 or more, and a sulfur content of 100 wppm or less.

17. The naphtha boiling range composition of clause 16, wherein the naphtha boiling to range composition comprises a T90 distillation point of 150° C. to 210° C.

18. The naphtha boiling range composition of clause 16-17, wherein the naphtha boiling range composition comprises a research octane number of 25 or more, or wherein the naphtha boiling range composition comprises a blending research octane number of 55 or more, or a combination thereof.

19. The naphtha boiling range composition of clause 16-18, wherein the naphtha boiling range composition comprises a smoke point of 25 mm or more.

20. Use of a composition comprising the naphtha boiling range composition of clauses 16-19 as a fuel in an engine, a furnace, a burner, a combustion device, or a combination thereof.

21. Use of the composition according to clause 20, wherein the naphtha boiling range composition has not been exposed to hydroprocessing conditions.

22. Use of the composition according to clauses 20-21, wherein the naphtha boiling range composition comprises a carbon intensity of 94 g $CO_2$eq/MJ of lower heating value or less.

23. A method for forming a naphtha boiling range composition, comprising:

fractionating a crude oil comprising a final boiling point of 600° C. or more to form at least a naphtha boiling range fraction, the crude oil comprising a naphthenes to aromatics weight ratio of 1.8 or more and a sulfur content of 0.2 wt % or less, the naphtha fraction comprising a T10 distillation point of 30° C. or more, a T90 distillation point of 210° C. or less, a naphthenes content 3 of 35 wt % to 50 wt %, a naphthenes to aromatics weight ratio of 4.0 or more, and a sulfur content of 100 wppm or less.

24. The method of clause 23, wherein the naphtha boiling range composition comprises a carbon intensity of 94 g $CO_2$eq/MJ of lower heating value or less.

25. The method of clauses 23-24, further comprising blending at least a portion of the naphtha boiling range fraction with a renewable fraction.

26. A method for forming a naphtha boiling range composition, comprising:

fractionating a crude oil comprising a final boiling point of 600° C. or more to form at least a naphtha boiling range fraction, the crude oil comprising a naphthenes to aromatics weight ratio of 1.8 or more and a sulfur content of 0.2 wt % or less, the naphtha boiling range fraction comprising a 190 distillation point of 80° C. or less, a naphthenes content of 6.0 wt % to 15 wt %, a naphthenes to aromatics weight ratio of 6.0 or more, and a sulfur content of 10 wppm or less.

27. The method of clause 26, further comprising exposing the naphtha boiling range fraction to isomerization conditions to form an isomerized naphtha boiling range fraction comprising a research octane number of 85 or more.

28. The method of clause 26-27, wherein the naphtha boiling range fraction is exposed to the isomerization conditions without being previously exposed to hydroprocessing conditions.

29. The method of clause 26-28, wherein the naphtha boiling range composition comprises a carbon intensity of 94 g $CO_2$eq/MJ of lower heating value or less.

30. The method of clauses 26-29, further comprising blending at least a portion of the naphtha boiling range fraction with a renewable fraction.

31. The method of clauses 26-30, further comprising exposing the naphtha boiling range fraction to catalytic reforming conditions to form a reformed naphtha boiling range fraction.

32. A method for forming a naphtha boiling range composition, comprising:

fractionating a crude oil comprising a final boiling point of 600° C. or more to form at least a naphtha boiling range fraction, the crude oil comprising a naphthenes to aromatics weight ratio of 1.8 or more and a sulfur content of 0.2 wt % or less, the naphtha fraction comprising a T10 distillation point of 140° C. or more, a T90 distillation point of 210° C. or less, a naphthenes content of 34 wt % to 50 wt %, a naphthenes to aromatics weight ratio of 3.0 or more, and a sulfur content of 100 wppm or less.

33. The method of clause 32, wherein the naphtha boiling range composition comprises a carbon intensity of 94 g $CO_2$eq/MJ of lower heating value or less.

34. The method of clauses 32-33, further comprising blending at least a portion of the naphtha boiling range fraction with a renewable fraction.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A naphtha boiling range composition comprising a T10 distillation point of 30° C. or more, a T90 distillation point of 210° C. or less, a naphthenes content of 35 wt % to 50 wt %, a naphthenes to aromatics weight ratio of 4.0 or more, and a sulfur content of 8 to 50 wppm and wherein the naphtha boiling range composition has not been exposed to hydroprocessing conditions.

2. The naphtha boiling range composition of claim 1, wherein the naphtha boiling range composition comprises a naphthenes to aromatics ratio of 4.5 or more.

3. The naphtha boiling range composition of claim 1, wherein the naphtha boiling range composition comprises a T90 distillation point of 80° C. to 180° C.

4. The naphtha boiling range composition of claim 1, wherein the naphtha boiling range composition comprises a research octane number of 55 or less, or wherein the naphtha boiling range composition comprises a blending research octane number of 60 or more, or a combination thereof.

5. The naphtha boiling range composition of claim 1, wherein the naphtha boiling range composition comprises a smoke point of 25 mm or more.

6. The naphtha boiling range composition of claim 1, wherein the naphtha boiling range composition is used as a fuel in an engine, a furnace, a burner, a combustion device, or a combination thereof.

7. The naphtha boiling range composition of claim 1, wherein the naphtha boiling range composition comprises a carbon intensity of 94 g $CO_2$eq/MJ of lower heating value or less.

8. A naphtha boiling range composition comprising a T90 distillation point of 80° C. or less, a naphthenes content of 6.0 wt % to 15 wt %, a naphthenes to aromatics weight ratio of 6.0 or more, and a sulfur content of 8 to 50 wppm and wherein the naphtha boiling range composition has not been exposed to hydroprocessing conditions.

9. The naphtha boiling range composition of claim 8, wherein the naphtha boiling range composition comprises a research octane number of 70 or more.

10. The naphtha boiling range composition of claim 8, wherein the naphtha boiling range composition comprises a research octane number of 85 or more.

11. The naphtha boiling range composition of claim 8, wherein the naphtha boiling range composition comprises an aniline point of 65° C. to 70° C., a smoke point of 32 mm or more, or a combination thereof.

12. The naphtha boiling range composition of claim 8, wherein the naphtha boiling range composition is used as a fuel in an engine, a furnace, a burner, a combustion device, or a combination thereof.

13. The naphtha boiling range composition of claim 8, wherein the naphtha boiling range composition comprises a carbon intensity of 94 g $CO_2$eq/MJ of lower heating value or less.

14. A naphtha boiling range composition comprising a T10 of 140° C. or more, a T90 distillation point of 210° C. or less, a naphthenes content of 34 wt % to 50 wt %, a naphthenes to aromatics weight ratio of 3.0 or more, and a sulfur content of 8 to 50 wppm and wherein the naphtha boiling range composition has not been exposed to hydroprocessing conditions.

15. The naphtha boiling range composition of claim 14, wherein the naphtha boiling range composition comprises a T90 distillation point of 150° C. to 210° C.

16. The naphtha boiling range composition of claim 14, wherein the naphtha boiling range composition comprises a research octane number of 25 or more, or wherein the naphtha boiling range composition comprises a blending research octane number of 55 or more, or a combination thereof.

17. The naphtha boiling range composition of claim 14, wherein the naphtha boiling range composition comprises a smoke point of 25 mm or more.

18. The naphtha boiling range composition of claim 14, wherein the naphtha boiling range composition is used as a fuel in an engine, a furnace, a burner, a combustion device, or a combination thereof.

19. The naphtha boiling range composition of claim 14, wherein the naphtha boiling range composition comprises a carbon intensity of 94 g $CO_2$eq/MJ of lower heating value or less.

20. A method for forming a naphtha boiling range composition, comprising:

fractionating a crude oil comprising a final boiling point of 600° C. or more to form at least a naphtha boiling range fraction, the crude oil comprising a naphthenes to aromatics weight ratio of 1.8 or more and a sulfur content of 0.2 wt % or less, the naphtha fraction comprising a T10 distillation point of 30° C. or more, a T90 distillation point of 210° C. or less, a naphthenes content of 35 wt % to 50 wt %, a naphthenes to aromatics weight ratio of 4.0 or more, and a sulfur content of 8 to 50 wppm and wherein the naphtha boiling range composition has not been exposed to hydroprocessing conditions.

21. The method of claim 20, wherein the naphtha boiling range composition comprises a carbon intensity of 94 g $CO_2$eq/MJ of lower heating value or less.

22. The method of claim 20, further comprising blending at least a portion of the naphtha boiling range fraction with a renewable fraction.

23. A method for forming a naphtha boiling range composition, comprising:

fractionating a crude oil comprising a final boiling point of 600° C. or more to form at least a naphtha boiling range fraction, the crude oil comprising a naphthenes to aromatics weight ratio of 1.8 or more and a sulfur content of 0.2 wt % or less, the naphtha boiling range fraction comprising a T90 distillation point of 80° C. or less, a naphthenes content of 6.0 wt % to 15 wt %, a naphthenes to aromatics weight ratio of 6.0 or more, and a sulfur content of 8 to 50 wppm and wherein the naphtha boiling range composition has not been exposed to hydroprocessing conditions.

24. The method of claim 23, further comprising exposing the naphtha boiling range fraction to isomerization conditions to form an isomerized naphtha boiling range fraction comprising a research octane number of 85 or more.

25. The method of claim 23, wherein the naphtha boiling range fraction is exposed to the isomerization conditions.

26. The method of claim 23, wherein the naphtha boiling range composition comprises a carbon intensity of 94 g $CO_2$eq/MJ of lower heating value or less.

27. The method of claim 23, further comprising blending at least a portion of the naphtha boiling range fraction with a renewable fraction.

28. The method of claim 23, further comprising exposing the naphtha boiling range fraction to catalytic reforming conditions to form a reformed naphtha boiling range fraction.

29. A method for forming a naphtha boiling range composition, comprising:

fractionating a crude oil comprising a final boiling point of 600° C. or more to form at least a naphtha boiling range fraction, the crude oil comprising a naphthenes to aromatics weight ratio of 1.8 or more and a sulfur content of 0.2 wt % or less, the naphtha fraction comprising a T10 distillation point of 140° C. or more, a T90 distillation point of 210° C. or less, a naphthenes content of 34 wt % to 50 wt %, a naphthenes to aromatics weight ratio of 3.0 or more, and a sulfur content of 8 to 50 wppm and wherein the naphtha boiling range composition has not been exposed to hydroprocessing conditions.

30. The method of claim 29, wherein the naphtha boiling range composition comprises a carbon intensity of 94 g $CO_2$eq/MJ of lower heating value or less.

31. The method of claim 29, further comprising blending at least a portion of the naphtha boiling range fraction with a renewable fraction.

* * * * *